US009177711B2

(12) United States Patent
Lee et al.

(10) Patent No.: US 9,177,711 B2
(45) Date of Patent: Nov. 3, 2015

(54) HEAT DISSIPATION STRUCTURE OF TRANSFORMER

(71) Applicant: Hyundai Motor Company, Seoul (KR)

(72) Inventors: Woo Young Lee, Chungcheongbuk-do (KR); Jin Young Yang, Hanam-si (KR); Byeong Seob Song, Yongin-si (KR); Dae Woo Lee, Gyeongsangbuk-do (KR); Inyong Yeo, Bucheon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/445,953

(22) Filed: Jul. 29, 2014

(65) Prior Publication Data

US 2015/0155088 A1 Jun. 4, 2015

(30) Foreign Application Priority Data

Dec. 3, 2013 (KR) ..... 10-2013-0149530

(51) Int. Cl.

| | |
|---|---|
| ***H01F 27/08*** | (2006.01) |
| ***H01F 27/24*** | (2006.01) |
| ***H01F 27/30*** | (2006.01) |
| ***H01F 27/02*** | (2006.01) |
| ***H01F 27/22*** | (2006.01) |
| ***H01F 27/26*** | (2006.01) |

(52) U.S. Cl.

CPC ..... *H01F 27/22* (2013.01); *H01F 27/266* (2013.01); *H01F 27/306* (2013.01)

(58) Field of Classification Search

CPC ..... H01F 27/00; H01F 27/08; H01F 27/02; H01F 27/22; H01F 27/26; H01F 27/263; H01F 27/266; H01F 27/2876; H01F 27/30; H01F 27/303; H01F 27/306; H01F 27/38; H01F 5/02; H01F 17/043; H01F 27/085; H01F 27/008; H01F 27/324; H01F 27/325

USPC ..... 336/61, 212, 198, 208, 90

See application file for complete search history.

(56) References Cited

U.S. PATENT DOCUMENTS

| | | | | |
|---|---|---|---|---|
| 5,469,124 | A * | 11/1995 | O'Donnell et al. | 336/61 |
| 2004/0257187 | A1* | 12/2004 | Drummond et al. | 336/61 |
| 2012/0169443 | A1* | 7/2012 | Takiguchi et al. | 336/61 |
| 2013/0182478 | A1 | 7/2013 | Nomura et al. | |
| 2013/0187738 | A1* | 7/2013 | Pal et al. | 336/61 |
| 2015/0061808 | A1* | 3/2015 | Iwakura et al. | 336/178 |

FOREIGN PATENT DOCUMENTS

| | | | |
|---|---|---|---|
| JP | 2008-041882 | A | 2/2008 |
| JP | 2010-205979 | A | 9/2010 |
| JP | 4672315 | B2 | 4/2011 |
| JP | 2012-160616 | A | 8/2012 |
| JP | 5267181 | B2 | 8/2013 |
| KR | 10-1320170 | B1 | 10/2013 |

* cited by examiner

*Primary Examiner* — Mangtin Lian

(74) *Attorney, Agent, or Firm* — McDermott Will & Emery LLP

(57) ABSTRACT

A heat dissipation structure of transformer includes a bobbin formed with a hollow shape and wound with a primary coil and a secondary coil. A core surrounds an inside and an outside of the bobbin by combining a pair of upper cores with a pair of lower cores. A heat dissipating plate is disposed between the pair of upper cores and the pair of lower cores. According to an exemplary embodiment of the present disclosure, heat generated inside of the core can be effectively exhausted outside by a heat dissipating plate disposed in the center of the core.

8 Claims, 5 Drawing Sheets

HEAT DISSIPATION STRUCTURE OF TRANSFORMER

CROSS-REFERENCE TO RELATED APPLICATION

This application claims the benefit of priority to Korean Patent Application No. 10-2013-0149530 filed in the Korean Intellectual Property Office on Dec. 3, 2013, the entire contents of which are incorporated herein by reference.

TECHNICAL FIELD

The present disclosure relates to a heat dissipation structure of a transformer. More particularly, the present disclosure relates to a new type of heat dissipation structure of a transformer for dissipating heat generated from a core of the transformer.

BACKGROUND

A transformer is an apparatus that transforms AC voltage or AC current by using electromagnetic induction. A general transformer includes a bobbin-wound primary coil and a secondary coil and a core formed with a magnetic material in order to surround an inside and an outside of a bobbin. The transformer further includes a semiconductor switch part such as a field-effect transistor (FET), an insulated gate bipolar transistor (IGBT), and a diode.

Recently, studies have been performed to reduce the entire volume of the transformer. A magnetic part such as the core takes the most volume in the transformer. However, a temperature of the core is increased when the volume of the core formed with a magnetic substance is reduced.

According to the conventional art to solve the above problem, thermal grease is applied to a bottom surface of an assembly combined with a core and a bobbin. The assembly is mounted to a housing and fixed to the housing after a heat dissipating plate is mounted at an upper side of the assembly. According to the conventional art as described above, an external temperature of the bobbin and the core surrounding the bobbin is reduced, but heat generated from an inside of the core cannot be dissipated.

For another example, an assembly combined with a core and a bobbin is inserted into a case, a molding liquid having a high heat conductivity is poured into the case, and the molding liquid is hardened. According to the conventional art as described above, the manufacturing cost of a transformer is increased by using the case and the molding liquid, and the entire volume of the transformer is increased.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a transformer for dissipating heat generated from a core. Also, the present disclosure provides a transformer for reducing a volume of the core occupying the largest volume in the transformer and for reducing the manufacturing cost.

A heat dissipation structure of a transformer according to an exemplary embodiment of the present disclosure includes a bobbin formed with a hollow shape and wound with a primary coil and a secondary coil. A core surrounds an inside and an outside of the bobbin by combining a pair of upper cores with a pair of lower cores. A heat dissipating plate is disposed between the pair of upper cores and the pair of lower cores.

The heat dissipating plate may include a bottom plate and an extended plate extending from the bottom plate, the pair of lower cores may be bonded to the bottom plate and the extended plate, and the pair of upper cores may be bonded to the extended plate.

The extended plate of the heat dissipating plate may include a center plate contacting a lower body portion and an upper body portion, and a pair of side plates are respectively disposed at opposite sides of the center plate and separated from the center plate.

The pair of upper cores may include an upper body portion disposed at a center of the bobbin and a pair of upper wing portions connected to the upper body portion and surrounding the outside of the bobbin.

The pair of upper cores are formed symmetrically based on the heat dissipating plate.

The pair of lower cores may include a lower body portion disposed at a center of the bobbin, and a pair of lower wing portions connected to the lower body portion and surrounding the outside of the bobbin.

The pair of lower cores may be formed symmetrically based on the heat dissipating plate.

The bobbin may be disposed between the center plate and the pair of side plates.

A thermal grease is coated between the pair of lower cores and the heat dissipating plate and between the pair of upper cores and the heat dissipating plate, and thus, the pair of lower cores and the pair of upper cores are bonded to the heat dissipating plate.

An assembly of the transformer is fixed to a housing by a clamp.

BRIEF DESCRIPTION OF THE DRAWINGS

The drawings are provided for reference in describing exemplary embodiments of the inventive concept, and the spirit of the present disclosure should not be construed only by the accompanying drawings.

DETAILED DESCRIPTION OF THE EMBODIMENTS

Figure 1:
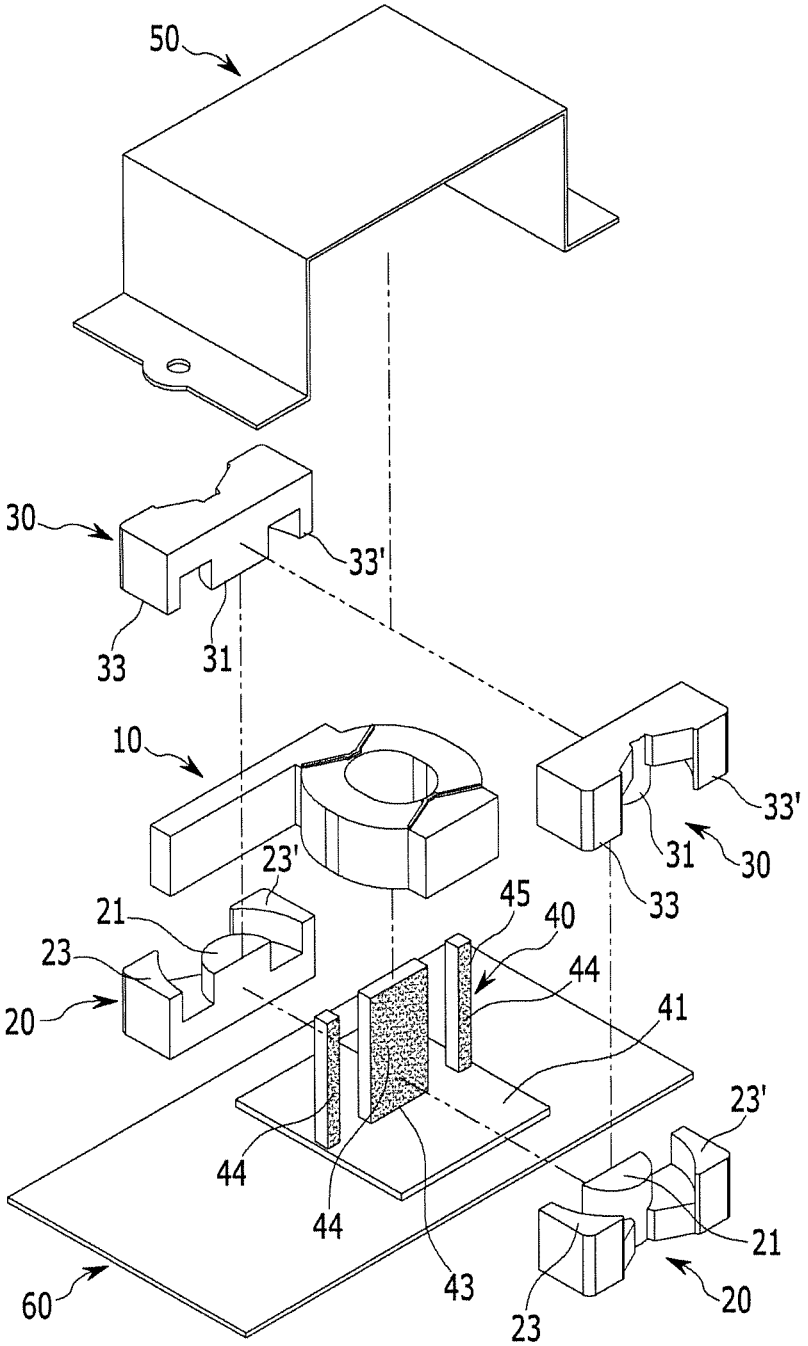
FIG. 1 is an exploded perspective view illustrating a transformer according to an exemplary embodiment of the present disclosure.

The present disclosure will be described more fully hereinafter with reference to the accompanying drawings, in which exemplary embodiments of the inventive concept are shown.

As those skilled in the art would realize, the described embodiments may be modified in various different ways, all without departing from the spirit or scope of the present disclosure.

In describing the present disclosure, parts that are not related to the description will be omitted. Like reference numerals generally designate like elements throughout the specification.

In addition, the size and thickness of each configuration shown in the drawings are arbitrarily shown for better understanding and ease of description, but the present disclosure is not limited thereto. In the drawings, the thickness of layers, films, panels, regions, etc., are exaggerated for clarity.

FIG. 1 is an exploded perspective view illustrating a transformer according to an exemplary embodiment of the present disclosure.

As shown in FIG. 1, a transformer according to an exemplary embodiment of the present disclosure includes a hollow shaped bobbin 10 wound with a primary coil and a secondary coil. A combination of a pair of upper cores 30 and a pair of lower cores 20 surrounds an inside and an outside of the bobbin 10 in upper and lower sides thereof. A heat dissipating plate 40 is disposed between the pair of upper cores 30 and the pair of lower cores 20.

A lower core 20 includes a lower body portion 21 disposed at a center of the bobbin 10, and a pair of lower wing portions 23, 23' connected the lower body portion 21 and surrounding an outside of the bobbin 10.

An upper core 30 includes an upper body portion 31 disposed at a center the bobbin 10, and a pair of upper wing portions 33, 33' connected to the upper body portion 31 and surrounding the outside of the bobbin 10.

The upper body portion 31 and the lower body portion 21 and the pair of upper wing portions 33, 33' and the pair of lower wing portions 23, 23' are combined, respectively at the upper and lower sides of the bobbin 10. The pair of upper wing portions 33, 33' and the pair of lower wing portions 23, 23' are combined in the up-and-down direction. At this time, the bobbin 10 is provided at a space formed by combining the upper core 30 and the lower core 20, and the upper core 30 and the lower core 20 surround the inside and outside of the bobbin 10.

The bobbin 10 is formed with a hollow shape and is made of an insulating material. The primary coil is wound outside of the bobbin 10, and the secondary coil is wound outside of the primary coil. An insulating material is provided between the primary coil and the secondary coil, and the primary coil and the secondary coil are thereby insulated.

The lower core 20 and the upper core 30 are made of a magnetic substance.

A magnetic flux is generated adjacent to the primary coil (between the lower body portion 21 and the upper body portion 31) when an AC current flows through the primary coil wound around the bobbin 10. At this time, a magnetic flux is generated adjacent to the secondary coil (between the lower wing portion and the upper wing portion) in a direction of disturbing a change of the magnetic flux generated by the primary coil. Therefore, current flows by generation of induced electromotive force.

The heat dissipating plate 40 includes a bottom plate 41 mounted to a housing 60 of the transformer, and an extended plate extended upward from the bottom plate 41. The extended plate includes a center plate 43 and a pair of side plates 45 disposed at opposite sides of the center plate 43. The pair of side plates 45 are separated from the center plate 43.

A bottom surface of the pair of lower cores 20 is mounted to the bottom plate 41, and the lower body portion 21 of the pair of lower cores 20 is bonded to the center plate 43. The lower wing portions 23, 23' of the pair of lower cores 20 are bonded to the pair of side plates 45.

The upper body portion 31 of the pair of upper cores 30 is bonded to the center plate 43, and the upper wing portions 33, 33' of the pair of upper cores 30 are bonded to the pair of side plates 45.

At this time, a thermal grease 44 is applied between the pair of upper body portions 31 and the center plate 43, between the pair of lower body portions 21 and the center plate 43, between the pair of upper wing portions 33, 33' and the side plate 45, and between the pair of lower wing portions 23, 23' and the side plate 45. Since the thermal grease 44 is applied between the core and the heat dissipating plate 40, heat generated from the core is transferred smoothly to the heat dissipating plate 40 and exhausted outside.

The pair of upper cores 30 and the pair of lower cores 20 are formed symmetrically based on the center plate 43 and the side plate 45.

The bobbin 10 is inserted into a space formed between the center plate 43 and the pair of side plates 45.

Since the heat dissipating plate 40 is provided between the pair of upper cores 30 and the pair of lower cores 20, heat generated from the cores 20 and 30 can be exhausted smoothly outside.

The heat generated from the cores 20 and 30 is exhausted smoothly outside, and thus, the entire volume of the cores 20 and 30 can be reduced.

Also, since the heat dissipating plate 40 is disposed between the pair of upper cores 30 and the pair of lower cores 20, a volume corresponding to a thickness of the heat dissipating plate 40 can be reduced. As described above, the heat dissipating plate 40 is provided between the pair of upper cores 30 and the pair of lower cores 20, such that, the entire volume of the cores 20 and 30 can be reduced.

Hereinafter, an assembly process of a heat dissipation structure of the transformer according to an exemplary embodiment of the present disclosure will be described. FIGS. 2 to 5 are schematic views illustrating an assembly process of a transformer according to an exemplary embodiment of the present disclosure.

Figure 2:
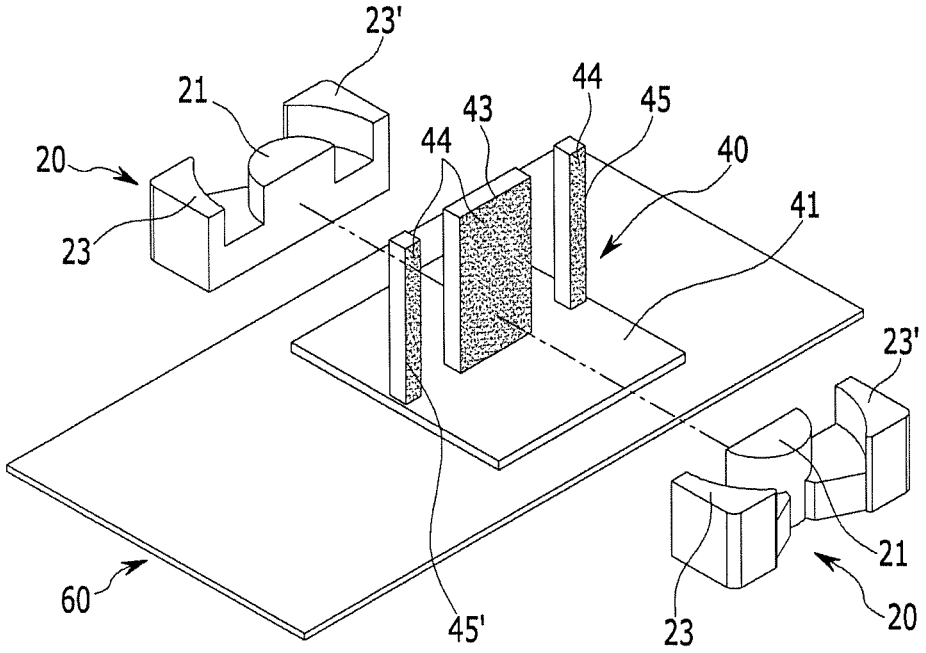
FIGS. 2 to 5 are schematic views illustrating assembly processes of a transformer according to an exemplary embodiment of the present disclosure.

As shown in FIG. 2, the pair of lower cores 20 are mounted to the bottom plate 41 of the heat dissipating plate 40. The lower body portions 21 are bonded at opposite sides of the center plate 43, and the lower wing portions 23, 23' are bonded at opposite sides of the pair of side plates 45. At this time, the pair of lower cores 20 and the heat dissipating plate 40 are bonded after a thermal grease 44 is applied between them. Heat generated from a combination of the lower and upper cores can be transferred smoothly to the heat dissipating plate 40 by the thermal grease 44, thus improving heat radiation.

Figure 3:
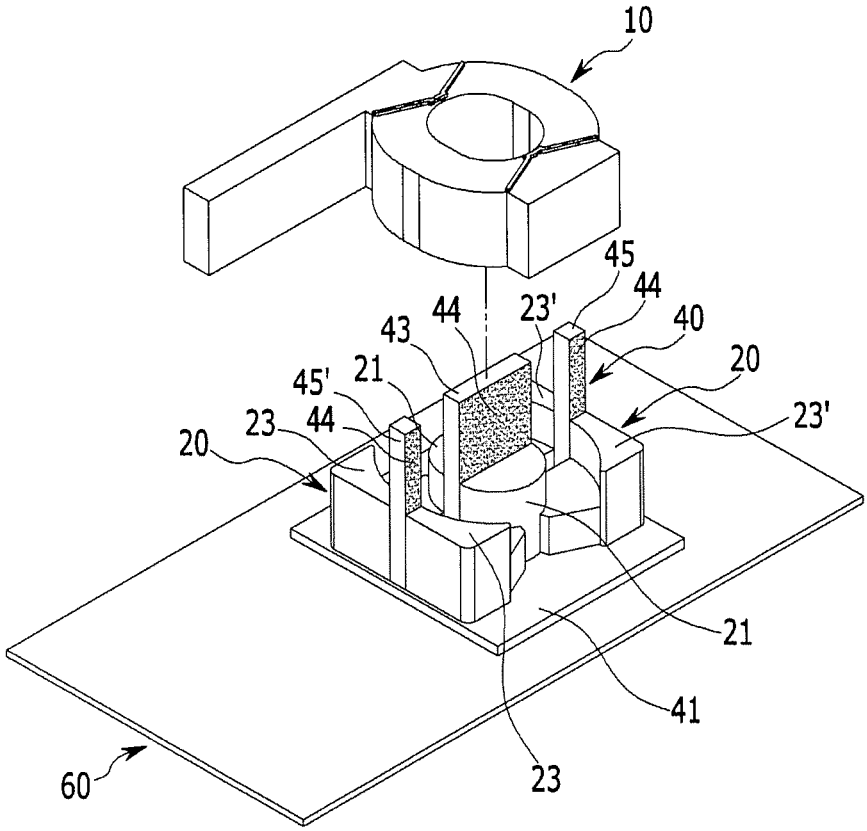

As shown in FIG. 3, the bobbin 10 is inserted into a space formed between the center plate 43 and the pair of side plates 45.

Figure 4:
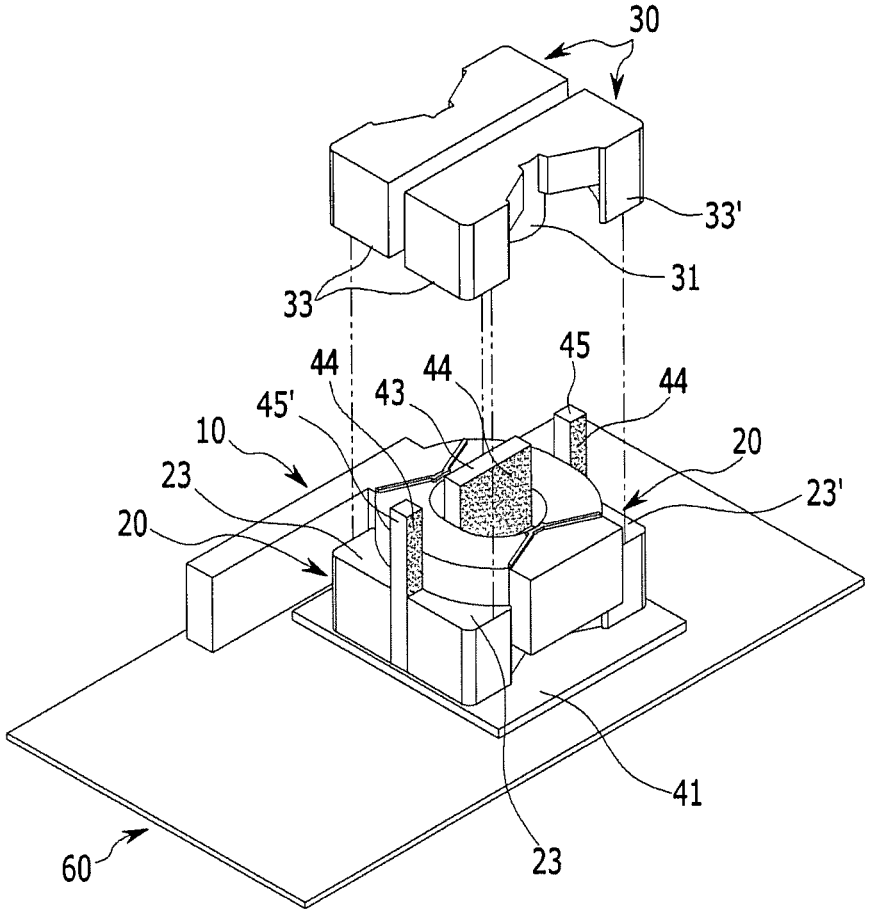

As shown in FIG. 4, the upper body portion 31 is bonded at opposite sides of the center plate 43, and the upper wing portions 33, 33' are bonded at opposite sides of the pair of side plates 45. At this time, the pair of upper cores 30 are bonded to the pair of lower cores 20, such that the bobbin 10 is disposed between the pair of lower/upper body portions 21/31 and the pair of lower/upper wing portions 23, 23'/33, 33'.

Further, the pair of upper cores 30 and the heat dissipating plate 40 are bonded after a thermal grease 44 is applied between the pair of upper cores 30 and the heat dissipating plate 40. Heat generated from the core can be transferred smoothly to the heat dissipating plate 40 by the thermal grease 44, thus improving the heat radiation.

Figure 5:
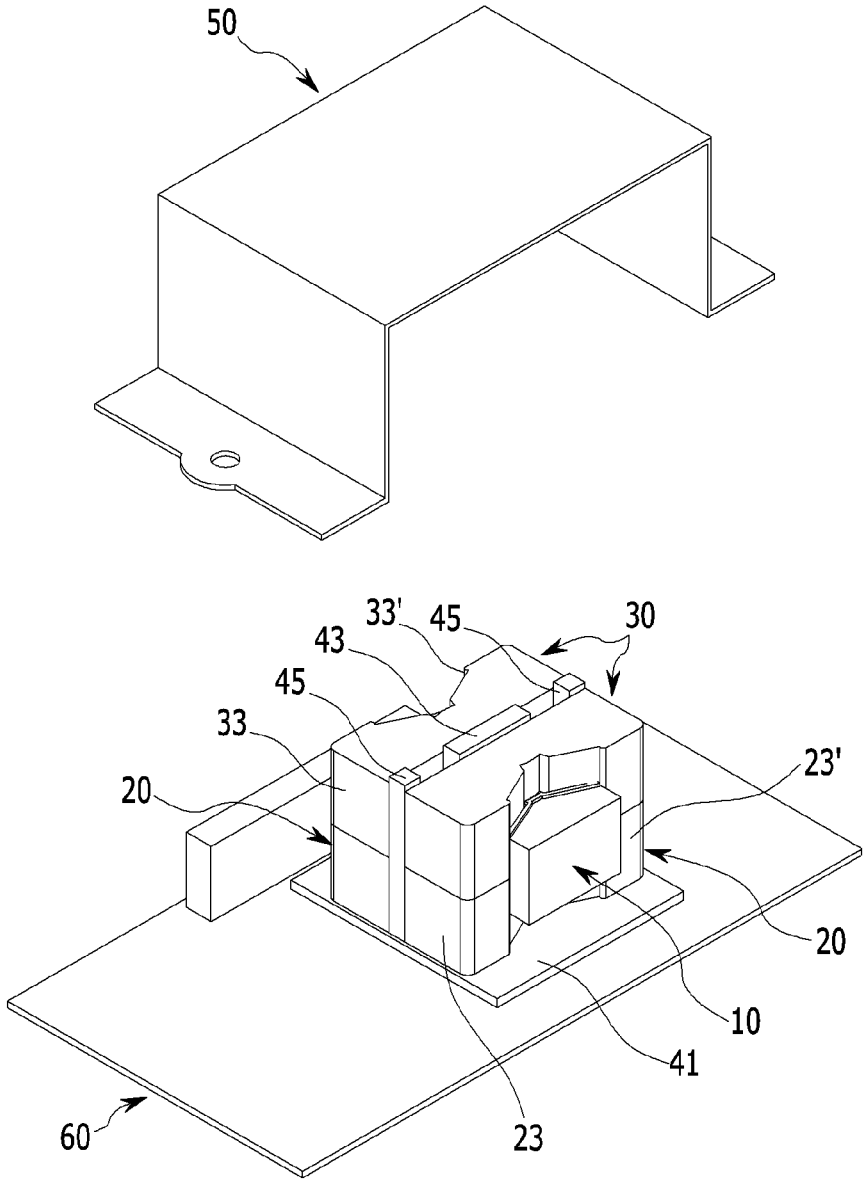

As shown in FIG. 5, an assembly of the transformer is fixed to the housing 60 by a clamp 50.

According to an exemplary embodiment of the present disclosure, heat generated inside of a core can be effectively exhausted outside by providing a heat dissipating plate in the center of a pair of cores.

Also, since a case and a molding liquid are not used, the manufacturing cost of the transformer can be reduced.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A heat dissipation structure of a transformer, comprising:

a hollow shaped bobbin wound with a primary coil and a secondary coil;

a core surrounding an inside and an outside of the bobbin by combining a pair of upper cores with a pair of lower cores so that the bobbin is covered by and disposed inside the pair of upper cores and the pair of lower cores; and a heat dissipating plate disposed between the pair of upper cores and the pair of lower cores, wherein the pair of upper cores include an upper body portion disposed at a center of the bobbin, and a pair of upper wing portions connected to the upper body portion and surrounding the outside of the bobbin, and the pair of lower cores include a lower body portion disposed at a center of the bobbin, and a pair of lower wing portions connected to the lower body portion and surrounding the outside of the bobbin.

2. The heat dissipation structure of transformer of claim 1, wherein the heat dissipating plate includes a bottom plate and an extended plate extending from the bottom plate, the pair of lower cores are bonded to the bottom plate and the extended plate, and the pair of upper cores are bonded to the extended plate.

3. The heat dissipation structure of transformer of claim 2, wherein the extended plate of the heat dissipating plate includes:

a center plate contacting the lower body portion and the upper body portion; and a pair of side plates are respectively disposed at opposite sides of the center plate and separated from the center plate.

4. The heat dissipation structure of transformer of claim 1, wherein the pair of upper cores are formed symmetrically based on the heat dissipating plate.

5. The heat dissipation structure of transformer of claim 1, wherein the pair of lower cores are formed symmetrically based on the heat dissipating plate.

6. The heat dissipation structure of transformer of claim 3, wherein the bobbin is disposed between the center plate and the pair of side plates.

7. The heat dissipation structure of transformer of claim 1, wherein a thermal grease is applied between the pair of lower cores and the heat dissipating plate and between the pair of upper cores and the heat dissipating plate, and thus, the pair of lower cores and the pair of upper cores are bonded to the heat dissipating plate.

8. The heat dissipation structure of transformer of claim 1, wherein an assembly of the transformer is fixed to a housing by a clamp.

* * * * *